United States Patent [19]

McGuire

[11] 4,030,414

[45] June 21, 1977

[54] WALL DECORATING PAINT APPLYING DEVICE

[76] Inventor: James T. McGuire, 3822 S. Rio Blanco, Las Vegas, Nev. 89101

[22] Filed: May 16, 1975

[21] Appl. No.: 578,086

[52] U.S. Cl. ..... 101/379; 15/143 R; 15/244 C; 15/210.5; 16/110 R; 118/102; 101/368; 101/405

[51] Int. Cl.[2] ..... B41K 1/02

[58] Field of Search ..... 101/368, 372, 401.1, 101/405, 406, 379, 211; 15/143, 244 R, 244 C, 210.5; 16/110 R, 116 A, 118, 121; D7/178; D7/79, 131; 118/102

[56] References Cited

UNITED STATES PATENTS

| | | | |
|---|---|---|---|
| 1,407,150 | 2/1922 | Gstalder | 15/210.5 |
| 1,595,820 | 8/1926 | Brede | 16/121 |
| 2,176,160 | 10/1939 | Uhl, Jr. | 101/405 |
| 2,684,012 | 7/1954 | Hebert | 101/368 |
| 2,712,160 | 7/1955 | Sterczek | 16/110 R |
| 3,142,082 | 7/1964 | Harwood | 101/368 |
| 3,142,855 | 8/1964 | Gilchrist | 15/244 R |
| 3,180,260 | 4/1965 | Joseph | 101/368 |
| 3,204,278 | 9/1965 | Lambros | 15/244 R |
| 3,209,686 | 10/1965 | Arthurs | 101/368 |
| 3,669,069 | 6/1972 | Bourboulis | 15/210.5 |
| 3,817,178 | 6/1974 | Hagen | 101/379 |
| D183,755 | 10/1958 | Lax | D7/79 |

FOREIGN PATENTS OR APPLICATIONS

| | | | |
|---|---|---|---|
| 1,032,293 | 6/1953 | France | 15/244 C |
| 1,434,159 | 11/1964 | France | 15/244 R |
| 351,134 | 4/1922 | Germany | 15/210.5 |
| 1,029,136 | 4/1958 | Germany | 15/244 R |

*Primary Examiner*—Edgar S. Burr
*Assistant Examiner*—William Pieprz
*Attorney, Agent, or Firm*—Warren, Chickering & Grunewald

[57] ABSTRACT

A wall decorating paint applying device which is composed of a one piece, unitary, soft, compressible, resiliently self-restoring, sponge body having a relieved, design defining, paint imprinting, face. The opposite side of the body is formed with an integral, finger grippable, sponge handle portion for manually handling the device in applying paint to the imprinting face and thereafter correctly positioning the face in compression on a wall surface to be decorated.

2 Claims, 9 Drawing Figures

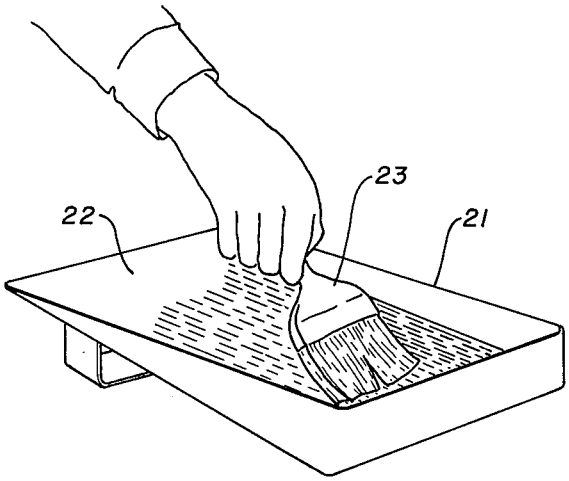
Fig. 4
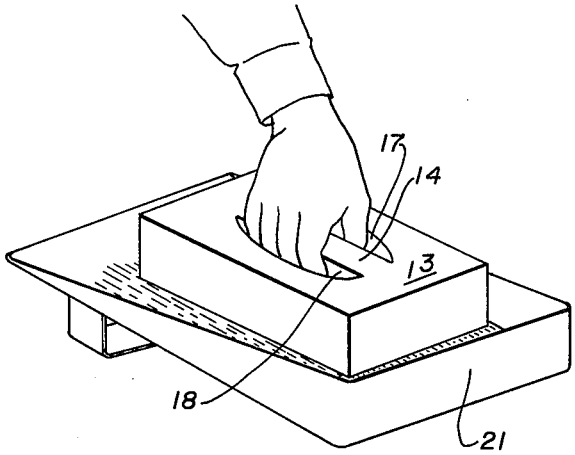
Fig. 5
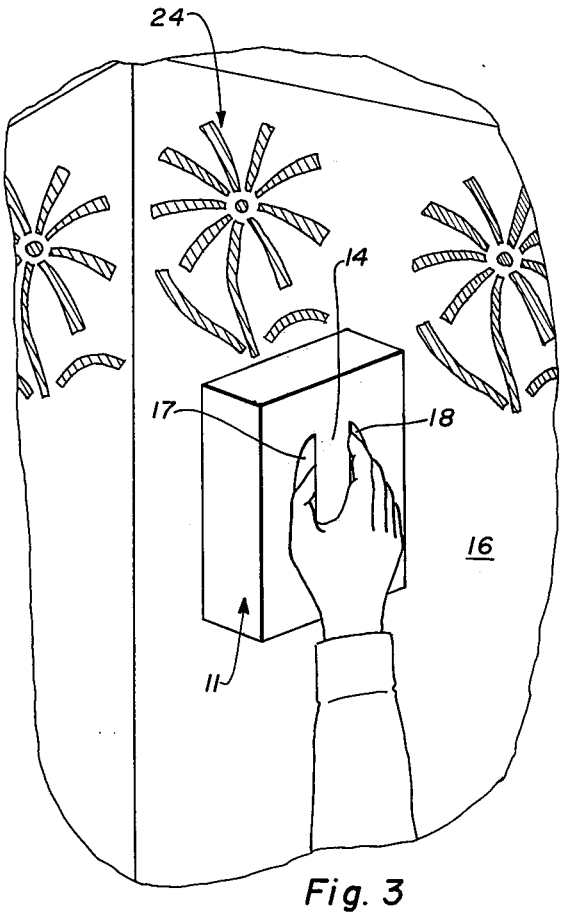
Fig. 3
Fig. 1
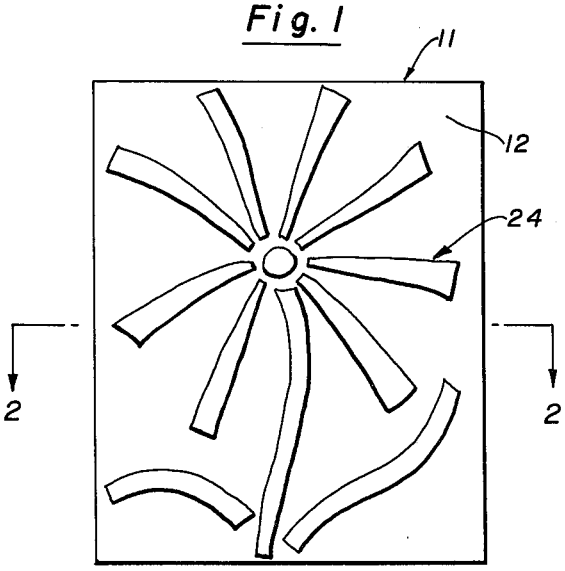
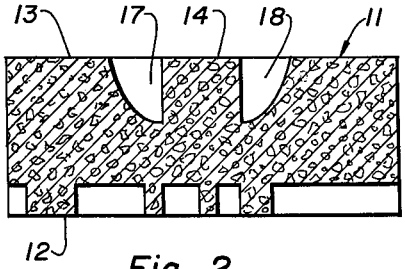
Fig. 2

WALL DECORATING PAINT APPLYING DEVICE

BACKGROUND OF THE INVENTION

1. Field of Invention

The invention relates to printing block type devices which are adapted for effecting wall decoration, see for U.S. Pat. No. 3,180,260.

2. Description of Prior Art

Various devices of the character described have been proposed for applying an ornamental design in paint or the like to a wall surface. Such devices are capable of producing a variety of appearances from a textured to a representational or nonrepresentational design. When properly applied, the result is attractive similar to the appearance of wallpaper, but at substantially reduced cost. Important to such proper application is the precise positioning of the device on the wall and the precise and uniform control of applied pressure over the printing face.

SUMMARY OF INVENTION

I have found that exceptionally fine results can be readily achieved by constructing the paint applying device from a one piece, unitary, soft, compressible, resiliently self-restoring, sponge body having a relieved, design defining, paint imprinting, face; and providing a hand engaging portion of the device as an integral part quite close to the printing face. The present device may be easily handled and positioned with requisite precision and applied with fine touch responsive pressure.

Another object of the present invention is to provide a wall decorating paint applying device of the character described which is compact, of minimum weight, composed of but a single part, and in which the entire device comprising the printing face and handle are structured within the confines of a block. The device thus presents no extensions or protuberances, and may be compactly packaged, stacked, stored and shipped without wasted space.

A further object of the present invention is to provide a wall decorating paint applying device of the character above which is economical in its use of paint, which may be used without spillage or dripping of paint, and which will apply an attractive design to the wall with minimum mess.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 1 is a front elevation of a wall decorating paint applying device constructed in accordance with the present invention.

FIG. 2 is a cross-sectional view taken substantially on the plane of line 2—2 of FIG. 1.

FIG. 3 is a perspective view depicting the application of the device to a wall.

FIGS. 4 and 5 are perspective views showing a paint tray and the application of paint to the printing face of the device.

Figure 8:
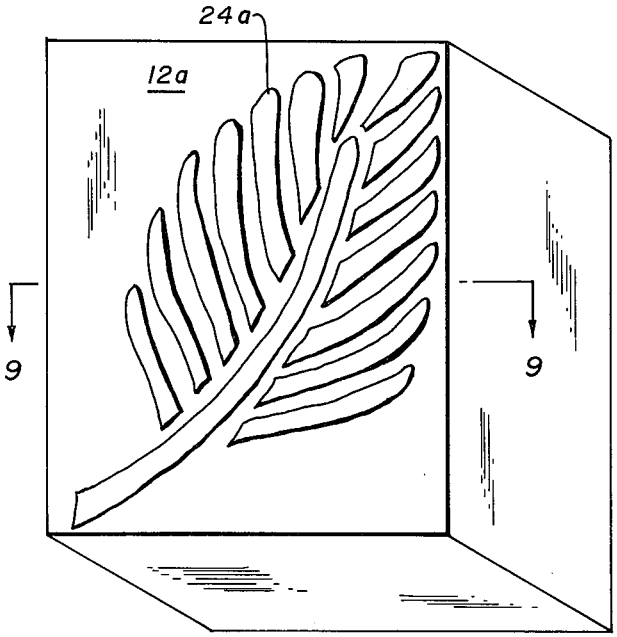
FIG. 8 is a perspective view showing the opposite side of the device.

Preferably, sponge body is composed of a plastic foam. Various plastic materials may be used having the requisite sponge-like quality. The common cellulose sponge is preferred. This material will pick up and express paint with good uniformity and precision.

With reference to FIGS. 2, 3 and 5, it will be noted that the block side 13 is formed with space apart finger receiving recesses 17 and 18 which leave therebetween a section 14 of the body providing the handle. Thus, in the preferred configuration of the device, a rectangular block shape as illustrated, face 12 and side 13 are disposed in substantially parallel planes with handle section 14 substantially flush with side 13, see FIG. 2. As will be noted, rear block side 13 is substantially parallel to front face 12 and recesses 17 and 18 are elongated to receive several fingers of the user's hand, as noted in FIGS. 3 and 5, and to define therebetween an elongated, integral, finger-grippable, soft, compressible sponge handle portion for manual squeezing and handling of the device and pressing of face 12, or portions thereof, onto the wall surface to be decorated. The flexibility and compressibility of handle portion 14 cofunctions with the compressible body to permit selectable flexing of the body and face, enabling imprinting of the wall surface with selected, substantially undistorted parts of the design to be applied to the wall surface.

Application of paint to face 12 may be conveniently effected by the use of a shallow paint pan or tray 21. Preferably, a shallow layer of paint is applied to the flat surface 22 of the tray as by means of a paint brush 23, see FIG. 4. The sponge body 11 is then manually engaged as illustrated in FIG. 5, and the imprinting face 12 is applied to tray surface 22 so as to absorb the paint uniformly over the printing face. The device may then be manually transported to wall 16 and applied thereto, as depicted in FIG. 3, so as to transfer the design 24 onto wall surface 16.

Figure 7:
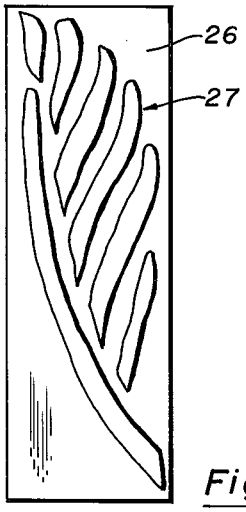
FIG. 7 is an end elevation of the device illustrated in FIG. 6.
Figure 6:
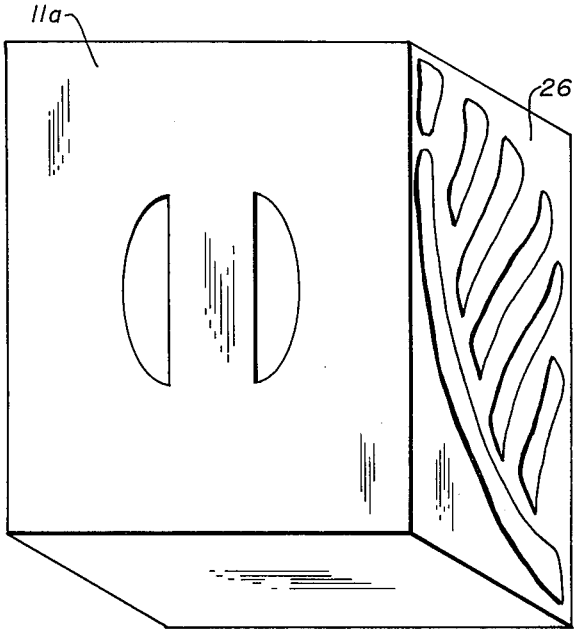
FIG. 6 is a perspective view of a modified form of the invention taken from one side thereof.
Figure 9:
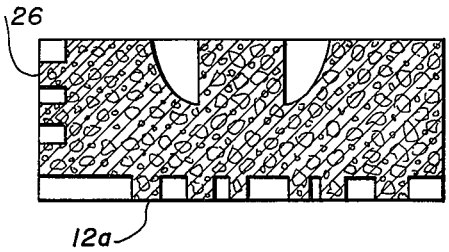
FIG. 9 is a cross-sectional view taken substantially on the plane of line 9—9 of FIG. 8. DETAILED DESCRIPTION OF INVENTION The wall decorating paint applying device of the present invention comprises briefly a one piece, unitary, soft, compressible, resiliently self-restoring, sponge body 11 having a relieved, design defining, paint imprinting, face 12; and a side 13 of the body opposite face 12 which is formed with an integral, finger grippable, sponge handle portion 14 for manual handling of the device and pressing of face 12 onto a wall surface 16 to be decorated. As an important feature of the present invention, body 11 comprises a block with face 12 and handle 14 disposed entirely within the confines of the block, see FIG. 2.

A modified form of the device is illustrated in FIGS. 6-9 wherein body 11*a* is formed with a second relieved, design defining, paint imprinting, face 26 in angular relation to printing face 12*a*. Where the configuration of the device is the rectangular block shape as here depicted, face 26 may be conveniently provided on an end surface of the block in perpendicular relation to the main or major printing face 12a. Design 27 provided on face 26 will accordingly be of somewhat reduced size and may be advantageously used as an adjunct to the major design 24a provided on surface 12a and on small wall areas such as between door frames and walls and the like.

The structure, use and application of the modified form of device are identical to device 11 above described.

After completing a wall decoration, the device may be easily cleaned by rinsing with water where latex paints are used or with thinner where oil paints or enamels are used.

What is claimed is:

1. A wall-decorating paint-applying device comprising:

a one-piece block-shaped unitary, soft compressible, resiliently self-restoring, sponge body having a deformable cellular paint retaining and applying face formed with relieved portions defining a decorative design to be applied to a wall or the like and a rear side; and means to enable flexing of said body and face to enable selected substantially undistorted parts of said design to be applied to said wall surface, said means including elongated finger-receiving recesses formed in said rear side, each recess capable of receiving a plurality of fingers, said rear side being opposite and substantially parallel to said face, said recesses leaving therebetween an elongated, integral, finger-grippable soft compressible sponge handle portion substantially flush with said rear side for manual squeezing and handling of said device and pressing of said face onto a wall surface to be decorated, the flexibility and compressibility of said handle portion providing flexing of said body and face.

2. A device as defined in claim 1, said body having a second soft compressible, resiliently self-restoring, paint retaining and applying face formed with relieved portions defining a decorative design and disposed substantially perpendicular to said side and first-named face.

* * * * *